United States Patent [19]

Calcabrini et al.

[11] Patent Number: 4,635,578

[45] Date of Patent: Jan. 13, 1987

[54] DEVICE FOR THE ERECTION OF THE MAST OF A SAILING BOARD

[76] Inventors: Vinicio Calcabrini, Zona Industriale Enrico Mattei, Via S. Agostino 38/B; Antonio Ferruccio, Via Gherarducci 76, both of 62019 Recanati (Macerata), Italy

[21] Appl. No.: 689,087

[22] Filed: Jan. 4, 1985

[30] Foreign Application Priority Data

Jan. 20, 1984 [IT] Italy ..... 47572 A/84

[51] Int. Cl.[4] ..... B63B 15/02

[52] U.S. Cl. ..... 114/39; 114/93

[58] Field of Search ..... 441/74; 114/39.2, 90, 114/93, 105, 298, 204

[56] References Cited

U.S. PATENT DOCUMENTS

| | | | |
|---|---|---|---|
| 2,415,605 | 2/1947 | Newby | 114/298 |
| 3,623,445 | 11/1971 | Holmes | 114/204 |
| 4,466,375 | 8/1984 | Marker | 441/74 |
| 4,527,499 | 7/1985 | Grant et al. | 114/93 |

FOREIGN PATENT DOCUMENTS

| | | | |
|---|---|---|---|
| 57-30679 | 2/1982 | Japan | 114/105 |
| 57-58589 | 4/1982 | Japan | 114/93 |
| 7607325 | 1/1977 | Netherlands | 114/93 |

*Primary Examiner*—Trygve M. Blix
*Assistant Examiner*—Edwin L. Swinehart
*Attorney, Agent, or Firm*—Browdy and Neimark

[57] ABSTRACT

A device for the erection of the mast of a sailing board adapted for use in the sport of windsurfing includes an articulated joint in which separate members are kept coupled together by means of a system comprising a flexible rope and a spring, where a displacement of the mast from the vertical attitude causes the loading of the spring thus creating a force tending to bring the mast back to a vertical attitude. The device may be assembled on a track that allows a change in the position of the foot of the mast through the operation of a pedal.

2 Claims, 11 Drawing Figures

DEVICE FOR THE ERECTION OF THE MAST OF A SAILING BOARD

The present invention relates to a device for the erection of the mast of a sailing board.

With the expression "sailing board" we mean the implements for windsurfing" on water, provided with sail, as well as the implements with wheels or skates for the practice of this kind of sport on ground referred to as "windskateboards".

OUTLINE OF PRIOR ART

It is known that the mast of a sailing board is erected on a mast foot that is inserted into holes present in the sailing board itself. These holes are in general in the number of two and allow placement of the mast in two positions on the sailing board.

It is also known that the foot of the mast is provided with a joint constituted of a flexible member, generally made of an elastomeric material shaped as a double cone, that may bend allowing to the mast to assume any inclined attitude with respect to the vertical, including a position in which the mast is completely horizontal. With this kind of articulated joint the position of the mast is determined by the balance between the force of the wind tending to bring down the mast and the force of the arms and the weight of the windsurfer. In particular when the mast has fallen down, it must be re-erected by means of a rope solely with an effort of the arms. The effort that the windsurfer has to make is quite appreciable and a continuous one and, even if this is quite common in any sport activity, many persons not sufficiently gifted with muscles, are compelled to give up the practice of this fascinating sport activity.

It is also known that some sailing boards are provided, in substitution of the holes for the erection of the mast, with a system that allows to arrange the foot of the mast in any position between two extreme positions, so that the position of the mast can be selected continuously at will, in order to have the center of force of the sail in the position most sought with respect to the board. These systems are however cumbersome in operation because it is necessary to use hands for operating them and this is an inconvenience for a windsurfer who is in open seas and in a precarious balance on the board.

SUMMARY OF THE INVENTION

It is the object of this invention to provide a mast foot device which constitutes an articulated joint that, while allowing the bending of the mast with respect to the vertical attitude, creates a force tending to restore the vertical attitude of the mast, providing in this way a help to the windsurfer who, with the device according to the present invention, will have to use only a fraction of the force of the arms that otherwise would be necessary with the conventional mast foot.

The device according to the present invention for the erection of the mast, includes a base fastened to the board that carries a first articulated joint member of the ball-joint type, a mast foot support that carries a second articulated joint member of the ball-joint type engaged with the first member of the base, for constituting an articulated joint of the ball-and-socket type, an elastic tie-member unit including a flexible member resistant to tensile stress restrained to the base and a return spring restrained between the support and the flexible member, the base and the support being kept together by the flexible member and being normally axially in register, so that a bending of the flexible member caused by a rotation in a vertical plane of the support with respect to the base, causes a strain upon the spring that produces a force tending to restore the support in alignment with said base, and a mast foot coaxial and freely rotatable around the support.

It is also object of the present invention a seat for the abovementioned device for the erection of the mast, that may be applied to sailing boards provided with holes for the assembly of the conventional mast foot, such seat allowing the positioning of the mast in any place between two extreme positions, by means of a simple operation performed with the foot.

The seat according to the present invention comprises two pins for its fastening to the two holes of the board, said seat having a guideway and a series of positioning holes, a slider that may be slidingly engaged with said guideway, said first articulation member of the ball-and-socket joint type being integral with said slider locking pins that can be engaged with said holes in the seat, a pedal lever hinged to said slider that controls the engagement and the release of said locking pins with the holes of said seat, elastically maintained in the engagement position, so that said slider may be positioned at will within said seat for defining the position of the mast of the sailing board.

DETAILED DESCRIPTION OF THE INVENTION

Figure 1:
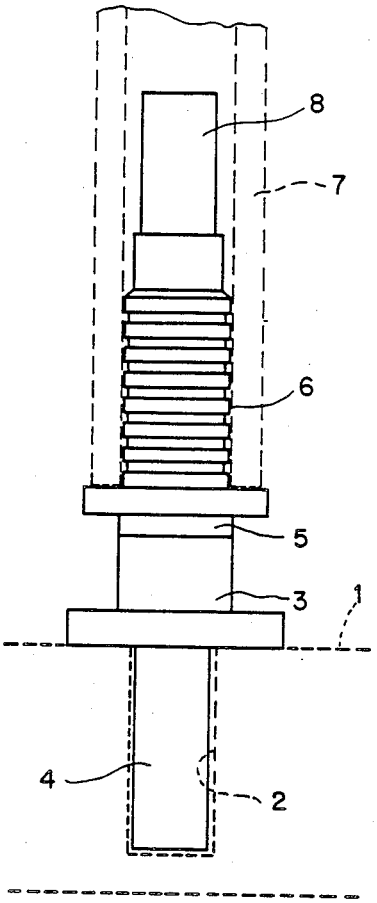
FIG. 1 is a view of the device according to the invention.

By referring at first to FIG. 1, the device according to the present invention is shown mounted on a sailing board 1 (drafted in dotted lines) provided with a hole 2 for the mounting of the device. The device includes a base 3 that constitutes a first member of an articulated joint, which is integral with a spine 4 for the insertion into the mounting hole 2. The device includes also a support 5 that constitutes a second member of an articulated joint, said support 5 being arranged for supporting a mast foot 6 on which the hollow mast 7 of the sailing board is mounted (shown with dotted lines). A lid 8 screwed on the support 5, as it will be disclosed hereinafter, closes on the top the device and keeps locked in position the mast foot 6 on the support 5.

The mast foot 6 is freely rotatable around a vertical axis with respect to the support 5 and moreover it follows the support 5 in any displacement of the same from the vertical attitude, in which the support 5 is aligned with the base 3.

Figure 2:
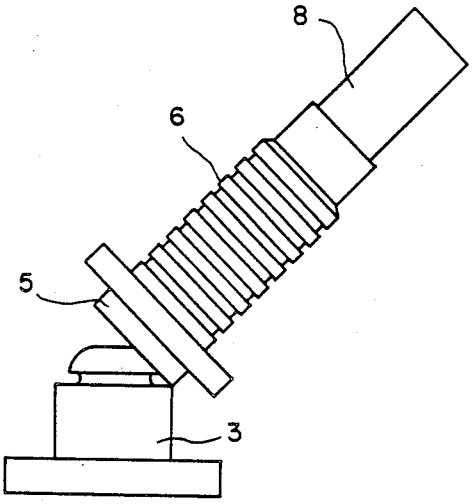
FIG. 2 shows the device of FIG. 1 with the articulated part inclined with respect to the vertical.

The support 5 and the base 3 are coupled together by means of an articulated joint, that will be disclosed into detail hereinafter, that allows a displacement of the base 3, and consequently of the mast 7, with respect to the vertical attitude, as it is shown as an illustration in FIG. 2.

As a matter of fact it is necessary that in the "windsurfing" practice the mast might assume any position with respect to the sailing board, including an absolutely vertical position and a practically horizontal position with the mast floating on water.

Figure 3:
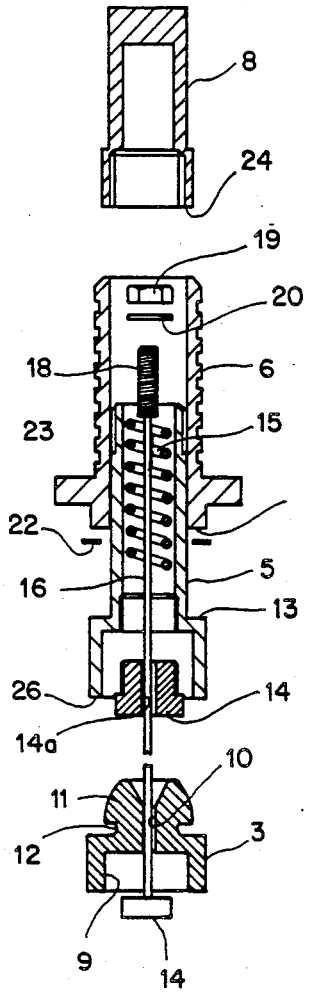
FIG. 3 is a sectional exploded view of the device of FIG. 1.

In FIG. 3, the members that constitute the device are shown in exploded view, with the mounting spine 4 having been omitted for sake of clarity.

Figure 4:
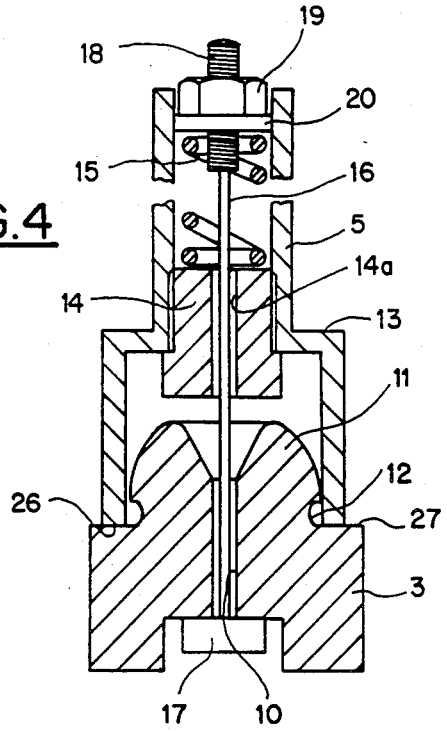
FIG. 4 shows a detail in sectional view that shows the members of the ball-and-socket articulated joint.

The base 3 comprises a strong body having a housing 9 and a through hole 10 at the top, the base 3 has a head 11 shaped as a sector of a sphere, having in the lower part a throat 12. The head 11 is traversed by the hole 10 which preferably is flared at the top. The support 5 for the mast foot 6 is comprised of a tubular body that preferably in the lower part of its wall has an increased diameter, so that a step or abutment is formed where the mast foot 6 will rest. The diameter of the lower part of the support 5 is such so that it may be coupled in a sufficiently tight fit, though with an appreciable clearance, because a tight precision is not necessary, around the head 11, as shown in enlarged scale in FIG. 4. A plug 14, traversed with a hole **14*a*, is screwed in the lower part in the restricted diameter portion of the support 5, as best seen in FIG. 4. The plug 14 serves as a bottom rest for the compression spring 15, that is arranged within the tubular housing of the support 5**.

A traction stress-resistant flexible member, preferably a steel rope 16, is arranged to extend through the hole 10 of the base 3, in the hole **14*a* of the plug 14 and at the interior of the support 5 and spring 15. The rope 16 is provided at its lower end with a stop 17 located in the housing 9 of the base 3, that prevents an upwards motion of the rope itself. At the top end, the rope 16 is integrally provided with a threaded rod 18 whereon a nut 19 is screwed that constitutes the top rest bearing for the spring 15, preferably through a washer 20 (as seen in FIG. 4**).

In FIG. 3 there is also shown the mast foot 6, that constitutes the member whereon the actual mast 7 of the sailing board is mounted and fastened. The mast foot 6 rests with its lower edge 21 on the step 13 of the support 5, preferably through an antifriction member 22, so that it can rotate freely with respect to the same support 5.

In FIG. 3, there is shown also the lid or cover 8 that is screwed on a threading 23 on the top external surface of the support 5, so that the lower edge 24 of the cover 8 may rest against the upper edge of the mast foot 6, so as to prevent this latter to get out from the support 5.

Figure 5:
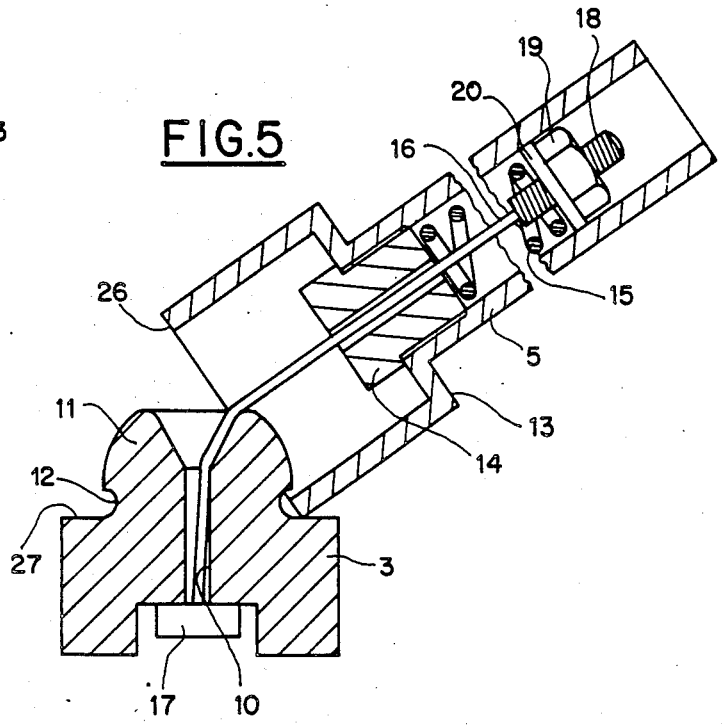
FIG. 5 shows the members of FIG. 4 with the support of the mast foot shown inclined.
Figure 6:
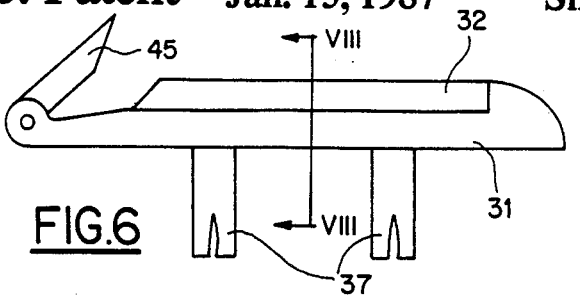
FIG. 6 shows a slide seat for the device according to the invention.
Figure 8:
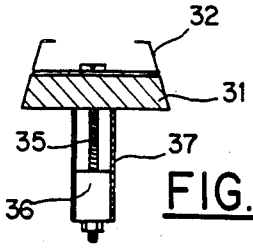
FIG. 8 is a section taken on the plane VIII—VIII of FIG. 6.
Figure 7:
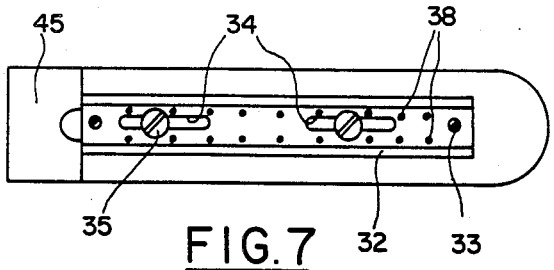
FIG. 7 is a top view of the device of FIG. 6.
Figure 9:
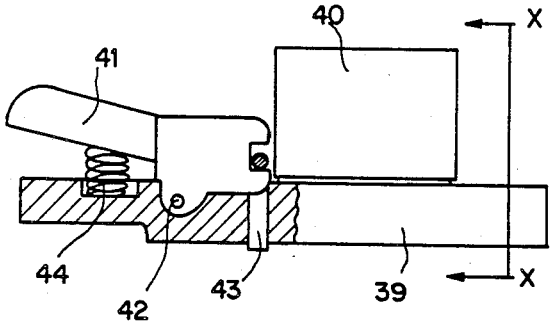
FIG. 9 shows the base of the device of FIG. 1, applicable to the seat of FIG. 6; shown in partial section.
Figure 10:
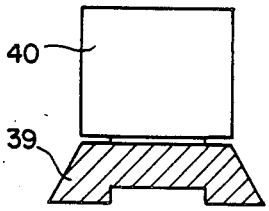
FIG. 10 shows a sectional view according to plane X—X of FIG. 9.

With reference to FIGS. 4 and 5 the operation of the device will be described.

The device is mounted by inserting the rope 16 into the hole 10 of the base 3 and into the hole **14*a* of the plug 14. With the rope 16 still loose, the plug 14 is screwed in the support 5 and the support 5 is then laid down with its lower edge 26 onto a surface 27 supporting the base 3, around the head 11. Then the spring 15 is inserted by placing it on the plug 14 and on the threaded rod 18 that protrudes outside of the support 5, the washer 20 is inserted and the nut 19 is screwed, so that the looseness of the rope 16 is completely taken out, up to when the stop 17 contacts the base 3 and, possibly, the nut 19 may be further tightened in order to compress the spring 15 and to put the rope 16 under a predetermined initial tension stress. In this way the whole is kept constrained and in the absence of other stresses, the attitude of the support 5 remains vertical and aligned with the base 3. When the mast with the sail is mounted on the mast foot (not shown) the force of the wind on the center of the sail will transmit to the support 5 a force tending to distrub alignment the support 5 with respect to the base 3** to place it in an attitude different from a vertical one. In conventional "windsurfing" systems, such a force is opposed by the surfer who, by shifting his own weight and by applying force via his arms, adjusts the attitude condition of the mast in the most suitable way.

In the device according to the present invention (see in particular FIG. 5) a displacement of the mast with respect to its vertical attitude will cause, owing to the increase of the distance between the plug 14 and the head 11, while the length of the rope between the stop 17 and the nut 19 remains unchanged, a return of the nut 19 and of the washer 20 towards the interior of the support 5. This, in turn, will cause the compression of the spring 15 between the washer 20 and the plug 14 and the creation of an elastic force that opposes the maintainment of the mast in a position different from the vertical one.

This restoring or return elastic force may be suitably trimed either by means of the design of the spring, or by means of a more or less deep screwing down of the nut 19 on the rod 18. The aim of the present invention is not that of having the mast to come back to the vertical position under the restoring action of the spring, even if this is possible from the theoretical standpoint, but to add to the force developed by the arms and the weight of the windsurfer for balancing the push of the wind, the force derived from the compression of the spring 15.

In this way, indeed, the restoring force of the spring assist the surfer in his effort of preventing that the mast falls down completely and consequently reduces physical effort of the surfer. Since for the majority of manuevers with the sailing board, the attitude of the mast will not deviate too greatly from the vertical, the action performed by the spring will constitute simply an assist to the surfer.

However, as it happens frequently, particularly with beginners and the less experienced windsurfers, the mast falls down completely in water becoming practically horizontal, and the spring 15 in such a case is compressed at its maximum. In such a case, the spring will provide then the maximum contribution to the effort of re-erecting the sail, and precisely, in a circumstance in which the effort needed by the windsurfer is a maximum one. If the restoring force produced by the spring 15 is trimmed so that it is just a bit lower than the weight of the mast and of the sail, in order to re-erect the mast it will be necessary to only exert a small pull on the line provided for this purpose, so that the mast, together with a sail deprived of wind, re-erects almostly without human intervention. It is obvious however that the windsurfer himself may adjust the restoring force provided by the spring, by screwing more or less in depth the nut 19.

As can be seen in FIG. 5, in the inclined position of the support 5, the lower edge 26 of the same remains resting on the abutment surface 27 of the base 3 remaining engaged with the throat 12 of the head 11. In this attitude, there is formed an instantaneous point of rotation constituted by the contact between the edge 26 and the abutment surface 27, this point being offset with respect to the upper end of the hole 10 of the base, for which the pull force exerted by the rope 16 creates the necessary torque for restoring the support 5 in its vertical attitude.

In the vertical attitude, or for very limited displacements from the vertical attitude, the internal surface of the support 5 is maintained in contact with the head 11, preferably shaped as a sector of a sphere, thus realizing a ball-and-socket joint effect almost perfect. The device according to the present invention may be made of a plastic material, preferably one having the properties of nylon.

As it has been said hereinbefore, the device according to the present invention may be mounted on the sailing board by inserting a conventional spine, integral with the base 3, in the mounting hole of the sailing board. However the device according to the invention may also be mounted on conventional sailing boards provided with a pair of mounting holes, by means of a seat that allows the positioning of the device itself in a whatsoever point within the seat itself, and this constitutes a further feature of the present invention.

With reference to the FIGS. 6 to 11, the seat 31, realized in plastic material, preferably one having the properties of nylon, is provided on the upper end with a metal guideway 32 fastened to the seat 31, as example by means of screws 33.

The guideway 32 has a channel general shape (see FIG. 8) and shows slots 34 corresponding to similar slots obtained in the body of the seat 31 (not shown) through which screws 35 are set engaged with conical expansion members 36 that are placed at the interior of spines 37 that can be inserted into the two mounting holes provided for in the sailing board.

The slots allow to compensate the different distances of the holes according to the particular sailing board on which the seat 31 should be mounted, and tightening the screws 35 that have a head that remains sunk and at level with the surface of the guideway 32, the expansion members 36 are drawn out and push the wall of the spines 37 against the wall of the mounting hole, locking thus in position the seat 31 on the sailing board.

The guideway 32 is moreover provided with a series of pairs of locating holes 38. These holes 38 serve to lock in position a slider 39 (FIGS. 9 and 10), that is inserted in the rear part of the guideway 32 and that has a shape complementary with that of the guideway 32, so that it may be kept into it and it may run along the same.

The slider carries integral therewith, a base member 40 that corresponds to the base 3 shown in the foregoing disclosure, that is part of the device according to the present invention.

On the rear part of the slider (the term "rear" means towards stern of the sailing board), there is arranged a pedal device that allows to shift the slider 39 with the foot along the slide 32. The pedal system includes a pedal lever 41 hinged at 42 to the slider 39, that engages a spine member 43 shaped as a stirrup, having two projections directed downward, spine shaped, that engage with the locating holes 38. A spring 44 maintains the pedal lever 41 in a position of engagement of the spines 43 with the holes 38, so that normally the slider is locked in a position at the interior of the guideway 32, corresponding to the engagement of the spines 43 with a pair of holes 38. On the rear part of the seat 31, there may be provided a wing 45 that in the closed condition prevents the exit of the slider 39 from the guideway 32 and that may be readily opened for the locking and unlocking of the same slider 39.

With this seat for the device according to the present invention, it is easy for the windsurfer to change the position of the mast on the sailing board, maintaining with his arms the mast in the vertical position, and operating with his foot the lever 41 so that the desired position is reached. With the seat of the present invention use of the hands for an operation of this kind is provided, as is necessary with arrangements according to the prior art. Moreover, since the seat 31 can be used with any kind of sailing board having two holes for the mounting of the mast, it allows a further maneuver for sailing boards that is otherwise not available with sailing boards of the prior art.

Figure 11:
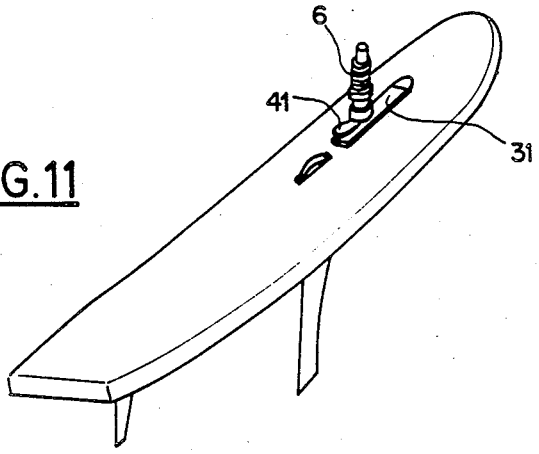
FIG. 11 shows a sailing board provided with a device according to the present invention.

In FIG. 11 there is shown a sailing board with the device according to the present invention indicated at 6, applied on a seat 31.

Notwithstanding the fact that in the shown embodiments the ball-and-socket joint between the base and the support of the mast foot has been represented with the head integral with the base, it is obvious that this arrangement could be inverted, realizing the spherical head integral with the support of the mast foot and realizing the base as a cup.

It is also obvious that the invention may be realized through equivalent modifications of the embodiments disclosed into detail in the present disclosure, and that such modifications fall within the scope of the present invention.

We claim:

1. A device for the erection of a mast of a sailing board, comprising:

a base member having a vertical passage therethrough, a head in the shape of a spherical sector, a throat at the base of the head, and an annular support surface located adjacent said throat and below said head;

a mast-foot support with an open tubular upper portion and an open tubular lower portion, the lower portion being of a larger diameter than the upper portion and forming an external rest for a mast-foot, said lower portion being adapted for loosely fitting around the head, and abutting on said support surface, of the base member;

a cylindrical plug having a longitudinal through-passage, threadedly engaged internally in the upper portion of the mast-foot support;

a mast-foot slidably and pivotally engaged on the outer surface of the upper portion, and resting on the external rest, of said mast-foot support;

a lid threadedly engaged at the top of said mast-foot support upper portion for locking said mast-foot in place;

and an elastic tie-member unit normally extending vertically between said base member and said mast-foot support, said tie-member unit including a steel rope, a threaded rod fixed to the upper end of said rope, said rope being restrained at its lower end to said base member and being disposed in the vertical passage of said base member and in the longitudinal passage of said plug, a nut screwed on said threaded rod, and a helical compression spring abutting said nut and said plug.

2. A device according to claim 1, and further including an antifriction bearing interposed between said mast-foot and the rest surface of said mast-foot support.

* * * * *